US005327663A

United States Patent [19]

Pryce

[11] Patent Number: 5,327,663

[45] Date of Patent: Jul. 12, 1994

[54] SUPINATION CONTROL SOLE AND SHOE

[76] Inventor: Michael L. Pryce, 6534 Sherborne La., Hudson, Ohio 44236

[21] Appl. No.: 32,878

[22] Filed: Mar. 18, 1993

[51] Int. Cl.[5] ..... A43B 7/22; A61F 5/14

[52] U.S. Cl. ..... 36/144; 36/140; 36/91; 36/71

[58] Field of Search ..... 36/43, 44, 88, 91, 93, 36/142, 143, 144, 180, 71, 140

[56] References Cited

U.S. PATENT DOCUMENTS

| | | | |
|---|---|---|---|
| 51,968 | 1/1866 | Plumer . | |
| 109,438 | 11/1870 | McComber . | |
| 1,362,157 | 12/1920 | Tuinder . | |
| 1,847,973 | 3/1932 | Morton | 36/180 |
| 1,974,161 | 9/1934 | Riley | 36/180 |
| 2,097,930 | 11/1937 | Lustig | 36/180 |
| 2,134,209 | 10/1938 | Schwenker | 12/133 |
| 2,207,833 | 7/1940 | Stark | 36/140 |
| 2,253,429 | 8/1941 | Hess | 36/180 |
| 2,330,398 | 9/1943 | Vass | 36/8.5 |
| 2,345,820 | 4/1944 | Kohn | 36/8.5 |
| 2,415,580 | 2/1947 | Davis | 36/8.5 |
| 2,423,622 | 7/1947 | Samblanet | 36/43 |
| 2,616,190 | 11/1952 | Darby | 36/71 |
| 2,835,908 | 5/1958 | Mott | 12/142 |
| 3,496,584 | 2/1970 | Heath | 12/133 |
| 3,641,688 | 2/1972 | von den Benken | 36/43 |
| 3,895,405 | 7/1975 | Edwards | 12/146 |
| 4,053,995 | 10/1977 | Shein | 36/88 |
| 4,128,951 | 12/1978 | Tansill | 36/44 |
| 4,266,553 | 5/1981 | Faiella | 128/585 |
| 4,428,089 | 1/1984 | Dawber et al. | 12/142 |
| 4,463,761 | 8/1984 | Pols et al. | 128/581 |
| 4,510,636 | 4/1985 | Phillips | 12/1 |
| 4,517,981 | 5/1985 | Santopietro et al. | 128/581 |
| 4,520,581 | 6/1985 | Irwin et al. | 36/88 |
| 4,522,777 | 6/1985 | Peterson | 264/223 |
| 4,578,882 | 4/1986 | Talarico, II | 36/103 |

*Primary Examiner*—Steven N. Meyers
*Assistant Examiner*—Marie Denise Patterson
*Attorney, Agent, or Firm*—John L. Gray

[57] ABSTRACT

A corrective foot insole for sufferers of an uncompensated forefoot varus, more commonly known as flexible flat foot. The corrective insole has a forefoot and a midfoot portion. The forefoot portion of the insole provides a lift for the two interior toes a distance back to, but not including the heel of the foot. The midfoot portion provides an additional lift to the metatarsal by use of a support arch which is located on top of the forefoot portion. The corrective foot insole allows the midfoot to rotate into supination. The entire first metatarsal and two interior toes are lifted into a position to compensate for the forefoot varus, and this insole also maintains the normal alignment position, motion and function of the entire foot during use of the corrective foot insole while maintaining the heel of the foot in its normal position.

1 Claim, 4 Drawing Sheets

SUPINATION CONTROL SOLE AND SHOE

BACKGROUND OF THE INVENTION

This invention relates to the correction of the human foot disorder of uncompensated forefoot varus, more commonly known as flexible flat foot.

The foot acts as a shock absorber and as a rigid lever for toeing off. In the normal condition when the foot hits the ground, the foot is in pronation when the heel strikes. When the heel strikes the ground, the foot will shiver as it absorbs the shock. The weight bearing then transfers from the heel along the lateral border of the foot until it reaches the fifth metatarsal phalangeal joint or the ball of the foot. Then the weight bearing transfers across the ball of the foot to the great toe.

Because the forefoot of a person with flexible flat foot is uncompensated, (the first metatarsal remains elevated off the ground), the forefoot cannot descend to the ground without excessively pronating the foot. In other words, a person will have to rock their foot to the inside in order to get the great toe down on the ground, and in doing so their foot never achieves the rigid status achieved by a supinated foot or a normal foot.

In the supinated or normal foot, the first metatarsal is always on the ground and the action occurs in the mid-tarsal joint. The mid-tarsal joint rotates slightly and then it locks allowing a person to toe off on the great toe. A person with a pronated foot cannot do this because he cannot put his first metatarsal on the ground unless he rolls his ankle to the inside. This invention allows a person with a flexible flat foot to toe off on the great toe without rolling his ankle to the inside.

The concept of correcting human foot disorders are discussed in patented art and are shown in various devices.

For example, U.S. Pat. No. 2,616,190, Darby, entitled "Walking Angle Corrective Footwear", issued Nov. 4, 1952. This patent shows a device for correction of human foot and leg disorders arising from incorrect weight bearing on the feet. Darby attempts to accomplish this by elevating the medial side of the shoe with an elevated outer fore-sole. Darby would not work for a person who has a flexible flat foot, because with a flexible flat foot, the heel stays in a fairly normal position. The abnormal anatomy occurs at the talus and navicular joint (talo-navicular joint) and in the calcaneus and cuboid joint (calcanco-cuboid joint), which are the two joints which make up the mid-tarsal joint. The difference between the type of problem that Darby is correcting and that which the present invention is correcting is that only the forefoot is in an uncorrected varus state in the flexible flat foot. Therefore, Darby's design does not correct the flexible flat foot because it attempts to correct the heel of the foot which does not need any correcting.

U.S. Pat. No. 4,578,882, Talarico, entitled "Forefoot Compensated Footwear", issued Apr. 1, 1986. This patent shows an angulated wedge-shaped sole sloping upward from the lateral aspect of the forefoot to the medial aspect, reducing excessive pronation and enabling the foot to act as an effective fulcrum and lever for walking or running steps with minimum waste of movement and distortion of the natural foot. If the midfoot is not held in supination, then the foot still tries to evert in the midfoot. Talarico starts his wedge at the base of the fifth metatarsal and angles towards the first metatarsal in a distal fashion. This leaves the midfoot entirely unsupported. In a patient with a normal foot, who can supinate his midfoot, nothing will occur. In the patient with the flexible flat foot, the patient cannot supinate his midfoot properly and the entire arch collapses and the forefoot descends to the surface. If, as in Talarico's model, the forefoot is compensated by a wedge, and the midfoot is not supported, then there will occur a paradoxical motion in which the forefoot is held inverted by the wedge, and the midfoot is allowed to evert. This is exactly what causes the pain in the flexible flat foot, and represents what this device is controlling.

None of the prior art is concerned with the combination of a raised wedge for the forefoot and midfoot, while maintaining the heel in its normal position flat on the ground.

These benefits, together with other objects and advantages of the invention will become more readily apparent to those skilled in the art when the following general statements and descriptions are read in light of the appended drawings.

SUMMARY OF THE INVENTION

A corrective foot insole, which herein means a shoe having such a sole, an insert, or an insole for sufferers of an uncompensated forefoot varus, more commonly known as flexible flat foot is described herein. The corrective insole was fashioned after research into the shape of the foot indicated that every foot placed in supination had the same shape, regardless of the dimensions. There are two areas which provide support for the deficient foot. The midfoot portion starts at the base of the heel and immediately rises forward to support the midfoot, which is critical to controlling the pronated foot. The present invention's support of the midfoot is a distinguishing feature over Talarico, since Talarico has no such midfoot support.

The forefoot portion of the present invention is positioned on top of the normal shoe sole, or as a replacement insole and extends from the front of the two interior toes a distance back to, but not including the heel of the foot. The forefoot portion gives elevation to mostly the first two metatarsals and continues forward to support the toes. As the contour of the insole travels from medial to lateral, the elevation diminishes so that the third, fourth and fifth metatarsals are in the naturally flat position. The corrective foot insole controls the midfoot supination by arresting midfoot pronation. The entire first and second metatarsal and two interior toes are lifted into a position to compensate for the forefoot varus, and this corrective insole also maintains the normal alignment, position, motion and function of the entire foot during use of the corrective insole while maintaining the heel in its normal position. Whereas the Darby invention provides a partial lift to the heel of the foot which is not found in the present invention.

DETAILED DESCRIPTION OF THE INVENTION

Figure 1:
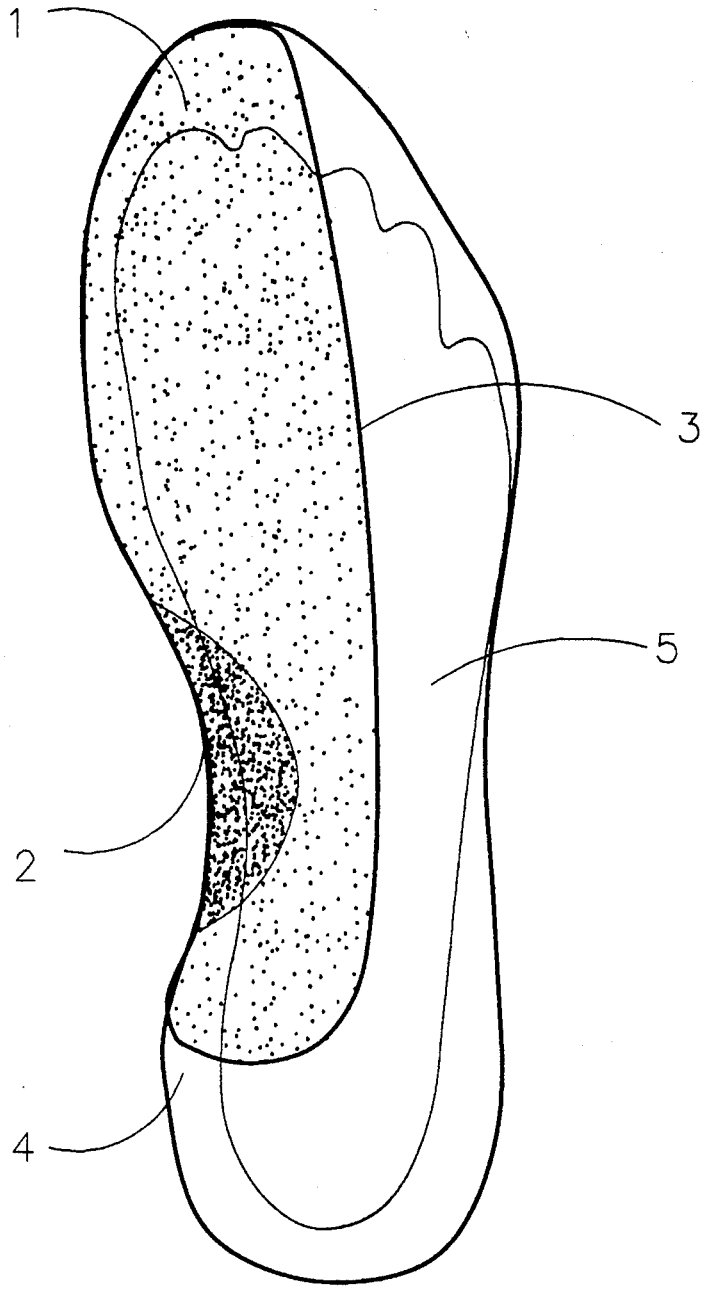
FIG. 1 is a top plan view of the corrective insole consisting of a forefoot and midfoot portion.
Figure 2:
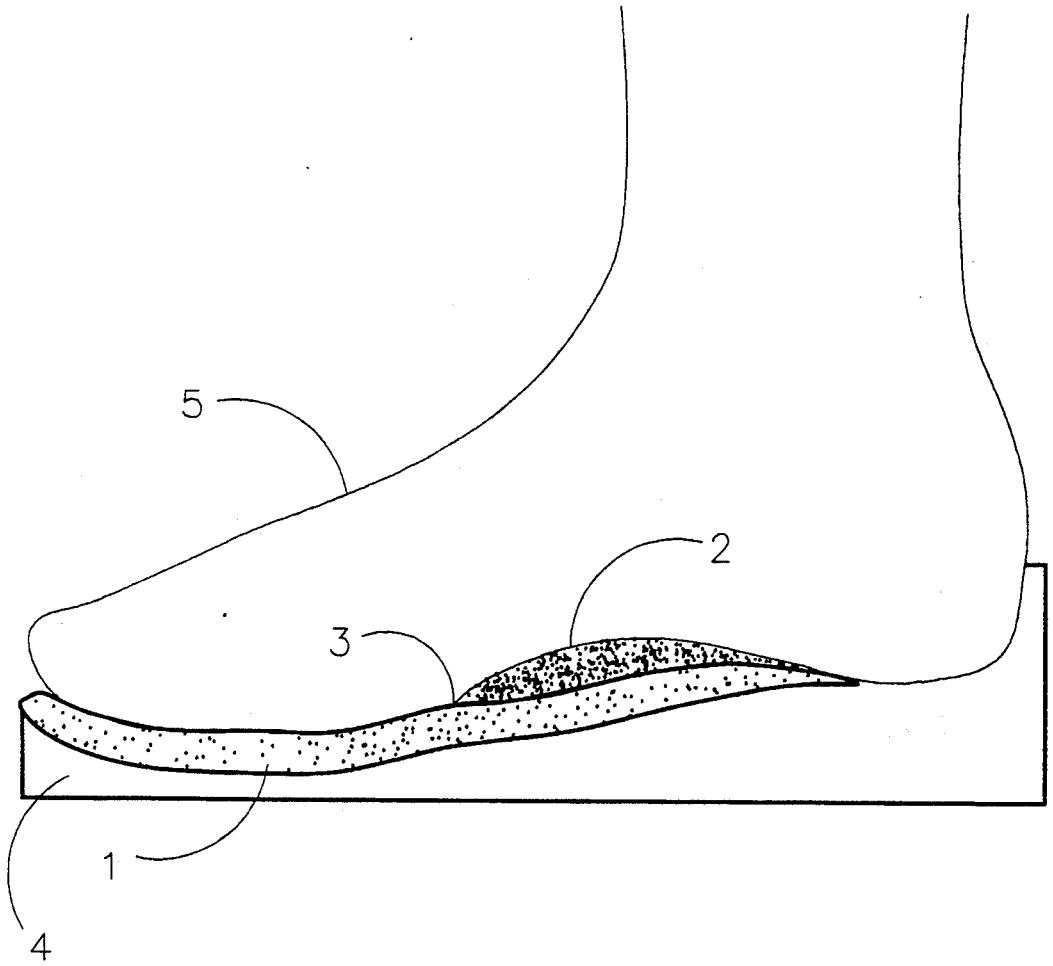
FIG. 2 is a side elevation view of the corrective insole illustrating the relationship of the midfoot portion and the forefoot portion.
Figure 3:
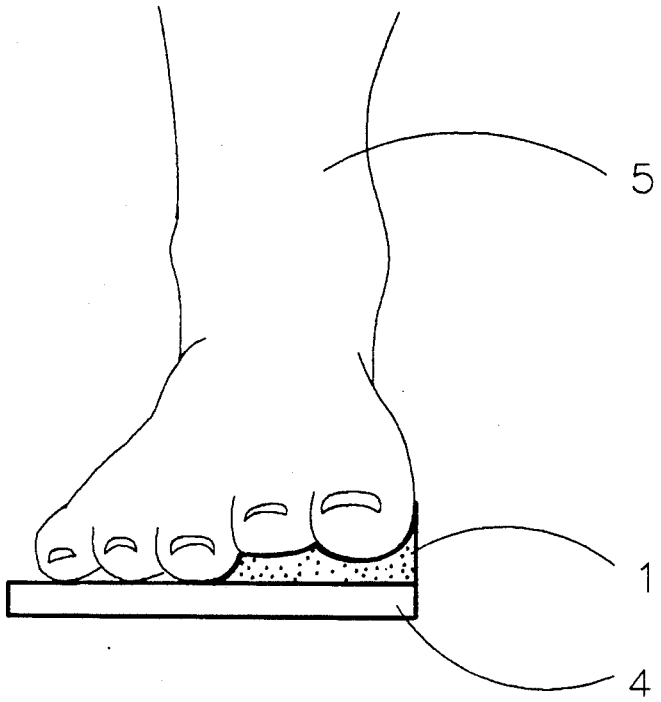
FIG. 3 is a front view of the forefoot portion of the corrective insole that provides a lift for the two interior toes.
Figure 4:
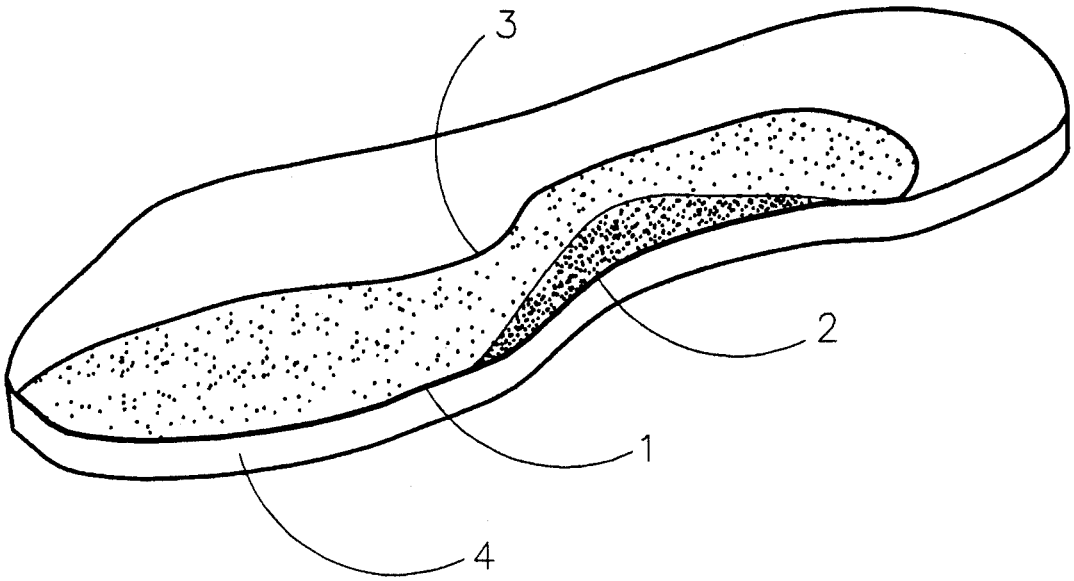
FIG. 4 is an elevated perspective view of the midfoot and forefoot portions of the corrective insole.

Referring to FIG. 1, there is shown the combination of the forefoot 1 and midfoot 2 portions of the corrective insole 3 along with the outline of human foot 5 sitting on top of the corrective insole 3. This invention is designed to function as a corrective insole 3 for sufferers of an uncompensated forefoot varus, more commonly known as flexible flat foot. The corrective insole 3 was fashioned after research into the shape of the flexible flat foot indicated that every foot placed in supination had the same shape, regardless of the dimensions.

The reason why this "same shape" for all flexible flat foot is significant is because this allows for one solution to correct all flexible flat foot problems. If the first metatarsal is raised such that the midfoot stays in supination when that person goes to toe off and the person would be toeing off their great toe, then the uncompensated forefoot varus in a flexible flat foot has been corrected.

There are two areas which provide support for the flexible flat foot. The midfoot portion starts at the anterior border of the heel and immediately rises to support the midfoot, and this is critical to controlling the pronated foot. The midfoot portion 2 is further supported by the forefoot portion which is located underneath it.

The forefoot portion 1 is positioned on top of the normal shoe sole 4 and extends from the front of the two interior toes of a human foot 5 a distance back to, but not including the heel of the foot. The forefoot portion 1 gives elevation to mostly the first two metatarsals and continues forward to support the two interior toes.

As the contour of the insole travels from medial to lateral, the elevation diminishes so that the third, fourth and fifth metatarsal are in the naturally flat position. The corrective insole controls the midfoot supination by not allowing the midfoot to pronate. The entire first and second metatarsal and two interior toes are lifted into a position to compensate for the forefoot varus and this corrective insole 3, also maintains the normal alignment, position, motion and function of the entire foot during use of the corrective insole 3 while maintaining the heel in its normal position.

What is claimed is:

1. A corrective foot insole in combination with footwear having a predetermined length and width, and forefoot, midfoot, and heel portions, comprising:

a raised forefoot portion of uniform thickness extending approximately half the width of the footwear such that it extends under the two medial toes, the forefoot portion extending from the front of the footwear to a distance less than the length of the footwear, such that it terminates in front of the heel portion of the footwear, and being substantially the same width throughout its length as said portion under the two medial toes of the wearer; and a midfoot portion being of substantially elliptical shape for supporting the metatarsal of the wearer and said midfoot portion of said insole being attached to the upper face of said raised forefoot portion of said insole and extending from the front of said midfoot portion of said footwear to a distance less than the length of the footwear such that it terminates in front of the heel portion.

* * * * *